US009724923B2

(12) United States Patent
Ono et al.

(10) Patent No.: US 9,724,923 B2
(45) Date of Patent: Aug. 8, 2017

(54) LIQUID EJECTION APPARATUS

(71) Applicant: SEIKO EPSON CORPORATION, Tokyo (JP)

(72) Inventors: Hirokazu Ono, Suwa (JP); Kenji Tsukada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/006,727

(22) Filed: Jan. 26, 2016

(65) Prior Publication Data

US 2016/0263896 A1 Sep. 15, 2016

(30) Foreign Application Priority Data

Mar. 13, 2015 (JP) ..... 2015-050509

(51) Int. Cl.
*B41J 2/17* (2006.01)
*B41J 2/165* (2006.01)

(52) U.S. Cl.
CPC ..... *B41J 2/16523* (2013.01); *B41J 2/16508* (2013.01); *B41J 2/16532* (2013.01); *B41J 2/16585* (2013.01); *B41J 2/1714* (2013.01)

(58) Field of Classification Search
CPC ..... B41J 2/16523; B41J 2/1721; B41J 2002/1728; B41J 2002/1735; B41J 2002/1742
See application file for complete search history.

(56) References Cited

U.S. PATENT DOCUMENTS

2005/0001873 A1 1/2005 Sugimura et al.
2007/0279465 A1* 12/2007 Shindo ..... B41J 2/16523 347/89
2010/0277523 A1 11/2010 Nishikawa
2012/0236074 A1* 9/2012 Harada ..... B41J 2/1721 347/36
2013/0241995 A1 9/2013 Maruyama

FOREIGN PATENT DOCUMENTS

| | | |
|---|---|---|
| EP | 2 292 433 | 3/2011 |
| JP | 2001-315357 | 11/2001 |
| JP | 2009-090480 | 4/2009 |
| JP | 2011-046108 | 3/2011 |
| JP | 2012-179881 | 9/2012 |

OTHER PUBLICATIONS

European Search Report for Application No. 16151535.8 dated Jun. 8, 2016.

* cited by examiner

*Primary Examiner* — Jason Uhlenhake
(74) *Attorney, Agent, or Firm* — Workman Nydegger

(57) ABSTRACT

A liquid ejection apparatus includes: a liquid ejection head having a nozzle which ejects a liquid containing volatile organic compounds to a medium; and a maintenance unit that has a cap, which forms a closed space including an opening of the nozzle, and a suction unit that suctions a fluid from the closed space, and that performs maintenance for discharging the liquid from the nozzle by reducing pressure of the closed space. The maintenance unit is provided with a filter for adsorbing volatile organic compounds contained in the liquid discharged from the liquid ejection head.

13 Claims, 10 Drawing Sheets

LIQUID EJECTION APPARATUS

BACKGROUND

1. Technical Field

The present invention relates to a liquid ejection apparatus.

2. Related Art

In the related art, in order not to discharge volatile organic compounds (VOC) contained in ink to the outside, a filter for adsorbing the VOC is provided in an exhaust duct of a printer. However, since a plurality of positions which opens to the outside are provided in a housing other than the duct, there is a concern that the VOC will be discharged from the positions other than the filter.

JP-A-2009-90480 discloses a configuration including a suction unit that suctions air within an apparatus and an exhaust duct having an exhaust port through which bottom suction air is discharged to the outside of the apparatus, and further includes a filter, in an exhaust port, for collecting volatile organic compounds in the air.

Japanese Patent No. 5626027 discloses a configuration which includes a collecting unit that collects volatile organic compounds vaporized from a liquid ejected along with air from an ejection head, and a combustion unit that causes the oxygen of the collected volatile organic compounds to be reacted using a platinum catalyst and to be combusted.

However, for example, a significant amount of volatile organic compounds is discharged in a printer having a unit such as a line head which is performed at an extraordinarily high printing speed. Therefore, it is not possible to sufficiently reduce the VOC in the configuration in the related art, and thus there is a concern that, in the future, it will not be possible for the discharge amount thereof to satisfy a regulation of a discharge amount of the volatile organic compounds which is regulated by an exhaust amount in a predetermined period of time.

SUMMARY

An advantage of some aspects of the invention is to provide a liquid ejection apparatus in which it is possible to efficiently collect volatile organic compounds contained in a liquid and to reduce an amount thereof discharged to the outside.

According to an aspect of the invention, there is provided a liquid ejection apparatus including: a liquid ejection head having a nozzle which ejects a liquid containing volatile organic compounds to a medium; and a maintenance unit that has a cap, which forms a closed space including an opening of the nozzle, and a suction unit that suctions a fluid from the closed space, and that performs maintenance for discharging the liquid from the nozzle by reducing pressure of the closed space, in which the maintenance unit is provided with a filter for adsorbing volatile organic compounds contained in the liquid discharged from the liquid ejection head.

In this case, since the fluid is accommodated in the maintenance unit in a state of a relatively high airtightness, the filter provided in the highly airtight maintenance unit enables an amount of the volatile organic compounds, which are discharged from the maintenance unit to the outside, to be significantly reduced. In addition, since the liquid is contained in a completely liquid state, it is possible to suppress the volatilization of the volatile organic compounds contained in the liquid. Accordingly, it is possible to reduce the amount of volatile organic compounds which are discharged to the outside of the maintenance unit and the liquid ejection apparatus.

In the liquid ejection apparatus, the maintenance unit may have a liquid waste container which is able to contain the fluid suctioned from the closed space, and the filter may be provided on an atmosphere open side of the liquid waste container.

In this case, even when the liquid waste container is configured to be opened to the atmosphere, it is possible to collect the volatile organic compounds existing in the liquid waste container in the filter. Therefore, it is possible to reduce volatile organic compounds which are released to the outside.

In the liquid ejection apparatus, the maintenance unit may include a fluid discharge path that connects the cap with the suction unit, an on-off device that opens and closes the fluid discharge path, and a buffer tank that forms a part of the fluid discharge path on the downstream side of the on-off device and that has a predetermined spatial volume. The buffer tank may communicate with the liquid waste container through the suction unit.

In this case, during the maintenance of the liquid ejection head, the suction unit reduces pressure and accumulates negative pressure in the buffer tank, which causes the negative pressure to be rapidly applied to the inside of the cap, and thereby causes the liquid to be discharged from the liquid ejection head. The liquid discharged to the inside of the cap is temporarily accommodated in the buffer tank due to the operation of the suction unit, and then flows to the liquid waste container. The filter provided on the atmosphere open side of the liquid waste container enables the volatile organic compounds contained in the fluid discharged from the buffer tank to be effectively removed.

In the liquid ejection apparatus, the maintenance unit may include a fluid discharge path that connects the cap with the suction unit, an on-off device that opens and closes the fluid discharge path, a buffer tank that forms a part of the fluid discharge path on the downstream side of the on-off device and that has a predetermined spatial volume, and a pressure reducing unit that is connected to the buffer tank and reducing pressure of a space of the buffer tank. The filter may be provided on at least one of a suction side and a discharge side of the pressure reducing unit.

In this case, during the maintenance of the liquid ejection head, the pressure reducing unit reduces pressure and accumulates negative pressure in the buffer tank, which causes the negative pressure to be rapidly applied to the inside of the cap, and thereby causes the liquid to be discharged from the liquid ejection head. However, at this time, gas which actively contains the volatile organic compounds is likely to be emitted to the outside from the buffer tank to which a large amount of the liquid flows. The filter provided on at least one of the suction side and the discharge side of the pressure reducing unit enables the volatile organic compounds contained in the fluid suctioned from the buffer tank to be effectively removed.

In the liquid ejection apparatus, the maintenance unit may have a waste liquid container which is able to contain the fluid suctioned from the closed space, and the discharge side of the pressure reducing unit may communicate with the waste liquid container through a passage.

In this case, even in a case where the liquid or the fluid containing the vaporized volatile organic compounds flows round to the pressure reducing unit side, the liquid is accommodated in the waste liquid container through the passage. Therefore, it is possible to prevent the liquid from leaking into the apparatus.

In the liquid ejection apparatus, the filter may be provided on the discharge side of the pressure reducing unit.

In this case, it is possible to adsorb the volatile organic compounds existing in the buffer tank by the filter.

In the liquid ejection apparatus, the filter may be provided on an atmosphere open side of the waste liquid container.

In this case, even when the waste liquid container is configured to be opened to the atmosphere, it is possible to collect the volatile organic compounds existing in the waste liquid container in the filter. Therefore, it is possible to reduce volatile organic compounds which are released to the outside.

In the liquid ejection apparatus, the maintenance unit may be provided with a first flow path, which passes through the filter, and a second flow path, which does not pass through the filter, in which a first on-off valve, which is openable and closable of the first flow path, may be provided on an inlet side of the first flow path, a second on-off valve, which is openable and closable of the second flow path, may be provided on an inlet side of the second flow path, and combinations of opening and closing operations of the first on-off valve and the second on-off valve enable selection of a flow path through which the fluid passes.

In this case, it is possible to select whether or not the liquid passes through the filter depending on the density of the volatile organic compounds such as causing the liquid containing a large amount of the volatile organic compounds to pass through the filter only during the maintenance and causing the liquid not to pass through the filter at the time of suctioning other than maintenance. Accordingly, it is possible to extend the service life of the filter.

In the liquid ejection apparatus, there may be further provided a mist collecting unit that collects mist generated when the liquid is ejected from the liquid ejection head, in which a discharge side of the mist collecting unit may be connected with the waste liquid container.

In this case, it is also possible to reduce the discharge amount of the volatile organic compounds contained in the mist.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, a first embodiment of a liquid ejection apparatus will be described with reference to the drawings.

For example, the liquid ejection apparatus is an ink jet type printer that ejects ink as an example of a liquid to a medium such as a sheet and thereby performs printing on the medium.

Figure 1:
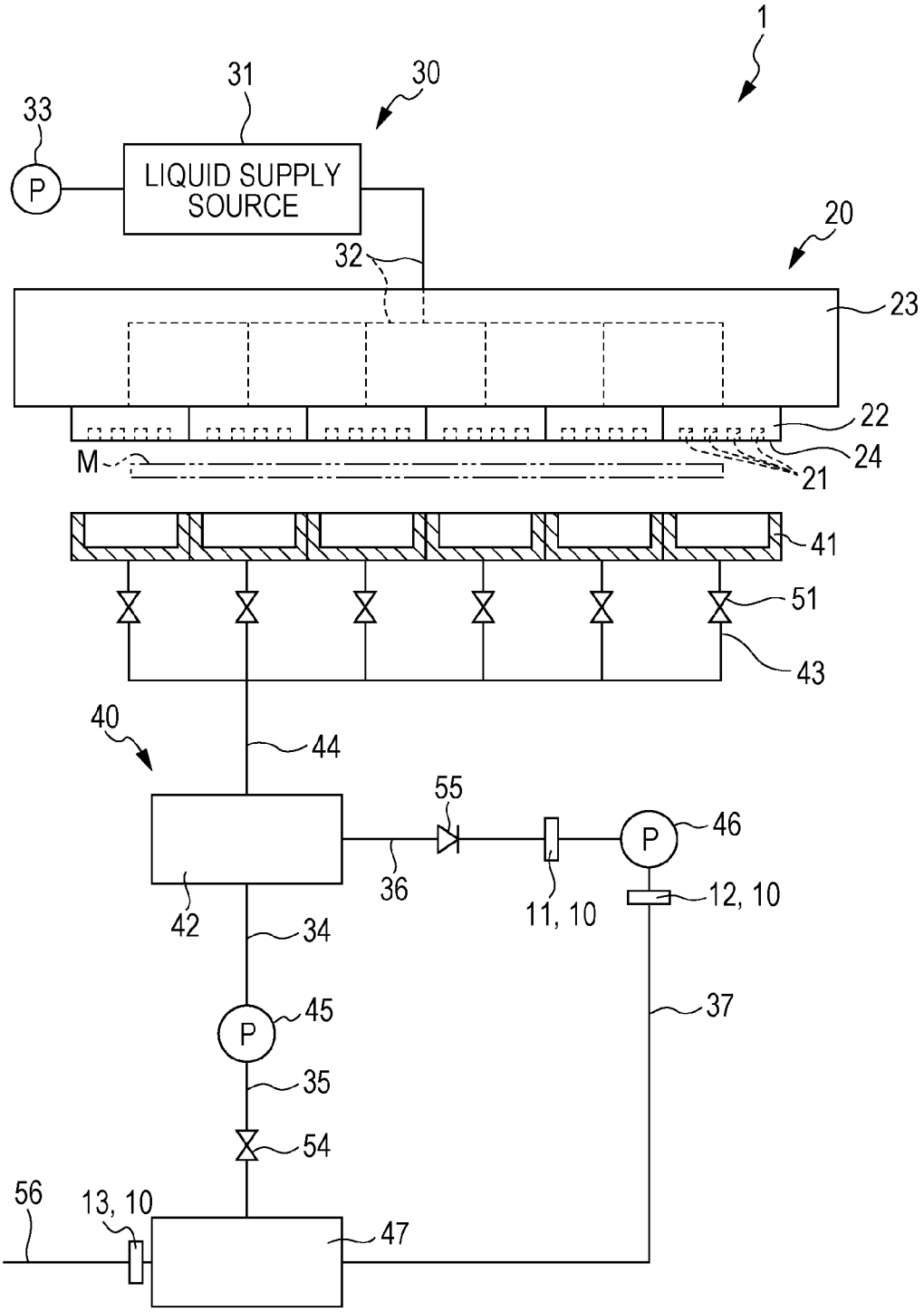
FIG. 1 is a diagram schematically illustrating a configuration of a liquid ejection apparatus of a first embodiment.

FIG. 1 is a diagram schematically illustrating a configuration of the liquid ejection apparatus of the first embodiment.

As illustrated in FIG. 1, a liquid ejection apparatus 1 includes a liquid ejection unit 20 that ejects ink (liquid) to a medium M, a liquid supply unit 30 that supplies the ink to the liquid ejection unit 20, and a maintenance unit 40 that performs maintenance of the liquid ejection unit 20.

The liquid ejection unit 20 includes a plurality of (in the first embodiment, six) liquid ejection heads 22 in which a plurality of nozzles 21 are formed, and a support 23 that supports the plurality of liquid ejection heads 22. In the first embodiment, the plurality of nozzles 21 formed in the liquid ejection head 22 correspond to an example of a "nozzle group". In addition, the plurality of liquid ejection heads 22 are arranged in parallel in a width direction (right-left direction in FIG. 1) of the medium M, which intersects with a transport direction (in FIG. 1, a direction orthogonal to the paper surface) of the medium M.

Further, in FIG. 1, the drawing is simplified for convenience of description; however, when the nozzles 21 of each of the liquid ejection heads 22 are projected in the transport direction of the medium M, the projected nozzles 21 of each of the liquid ejection heads 22 are arranged side by side at a certain interval in the width direction of the medium M.

The liquid supply unit 30 includes a liquid supply source 31 that stores ink which is supplied to the liquid ejection unit 20, a supply flow path 32 that connects the liquid supply source 31 with the liquid ejection unit 20, a pressurization pump 33 that is connected to the liquid supply source 31 and applies pressure to the ink stored in the liquid supply source 31 and supplies the ink to the liquid ejection unit 20. The liquid supply source 31 may be a liquid cartridge which is detachably mounted in the liquid ejection apparatus 1 or may be a liquid containing tank provided in the liquid ejection apparatus 1.

Driving of the pressurization pump 33 enables the supply flow path 32 to supply the liquid to the liquid ejection unit 20 from the liquid supply source 31.

The maintenance unit 40 includes a cap 41 which causes a space including an opening of the nozzle 21 of the liquid ejection head 22 to be formed as a closed space CP (refer to FIG. 5), a buffer tank 42 having a predetermined spatial volume which can store a fluid (including ink and gas) which is subjected to pressure reduction to a level lower than atmospheric pressure, an ink suction pump (suction unit) 45 and a pressure reducing pump (pressure reducing unit) 46 for reducing pressure of the space of the buffer tank 42 and suctioning the ink from the closed space CP, and a waste liquid container 47 that is able to contain the fluid including the ink discharged from the ink suction pump 45 and the pressure reducing pump 46.

In addition, the maintenance unit 40 includes a plurality of branched flow paths (fluid discharge path) 43 of which one end is connected to each of the cap 41, a joining flow path (fluid discharge path) 44 which connects the other end of each of the branched flow paths 43 with the buffer tank 42, a first suction-side flow path 34 that connects the buffer tank 42 and the ink suction pump 45, a first discharge-side flow path 35 that connects the ink suction pump 45 and the waste liquid container 47, a second suction-side flow path 36 that connects the buffer tank 42 and the pressure reducing pump 46, and a second discharge-side flow path (passage) 37 that connects the pressure reducing pump 46 and the waste liquid container 47.

Further, the maintenance unit 40 of the first embodiment includes a filter unit 10 for adsorbing volatile organic compounds contained in the ink discharged from the liquid ejection head 22.

The cap 41 has a bottomed box shape and is relatively movable with respect to a nozzle forming surface 24 of the liquid ejection head 22. Also, the cap 41 moves in an approaching direction to the liquid ejection head 22 and comes into contact with the nozzle forming surface 24, and thereby, the closed space CP is formed. In the first embodiment, in this manner, the cap 41 comes into contact with the nozzle forming surface 24 and forms the closed space CP, which is referred to as "capping". In addition, the cap 41 is separated from the nozzle forming surface 24 and thereby the closed space CP is eliminated, which is referred to as "uncapping".

A CP-side on-off valve (on-off device) 51 which allows or regulates circulation of the ink in the branched flow path 43 is provided on the branched flow path 43. Therefore, when the liquid ejection head 22 is capped with the cap 41 and the CP-side on-off valve 51 is opened, the closed space CP and the buffer tank 42 enter into a communication state through the branched flow path 43 and the joining flow path 44.

Meanwhile, when the liquid ejection head 22 is capped with the cap 41 and the CP-side on-off valve 51 is closed, the closed space CP and the buffer tank 42 enter into a non-communication state. When at least one of the ink suction pump 45 and the pressure reducing pump 46 is driven in a state in which the entire CP-side on-off valve 51 is closed, the buffer tank 42 is subjected to pressure reduction to have a pressure (negative pressure) lower than atmospheric pressure.

In addition, the liquid ejection head 22 is capped, and any CP-side on-off valve 51 is opened in a state in which the buffer tank 42 is subjected to pressure reduction to a level lower than atmospheric pressure. In this manner, any closed space CP communicating with the buffer tank 42 is subjected to the rapid pressure reduction.

Since an opening/closing operation can be independently performed on the CP-side on-off valves 51, only a specific CP-side on-off valve 51 is opened, and thereby only a specific closed space CP corresponding to the CP-side on-off valve 51 can enter into the communication state with the buffer tank 42.

Further, without providing the joining flow path 44, the other end of the branched flow path 43 may be directly connected to the buffer tank 42.

The ink suction pump 45 is connected to the buffer tank 42 through the first suction-side flow path 34 and reduces the pressure of the buffer tank 42 through the first suction-side flow path 34.

The discharge side of the ink suction pump 45 communicates with the waste liquid container 47 through the first discharge-side flow path 35. A suction pump-side on-off valve 54 is provided on the first discharge-side flow path 35.

The suction pump-side on-off valve 54 functions to prevent suctioning from the waste liquid container 47 which is constantly opened to the atmosphere and to reliably lower pressure only on the cap 41 side when the pressure reducing pump 46 performs suctioning from the buffer tank 42.

The pressure reducing pump (pressure reducing unit) 46 is connected to the buffer tank 42 through the second suction-side flow path 36 and reduces the pressure of the buffer tank 42 through the second suction-side flow path 36. The pressure reducing pump 46, due to a suction force thereof, suctions gas containing the volatile organic compounds vaporized from the ink in the buffer tank 42. At this time, it is desirable that the ink is not suctioned.

The discharge side of the pressure reducing pump 46 communicates with the waste liquid container 47 through the second discharge-side flow path 37.

A check valve 55 is disposed on the second suction-side flow path 36. The check valve 55 allows only gas to flow toward the pressure reducing pump 46 side from the buffer tank 42 and prevents the reverse flow of the gas toward the buffer tank 42 side from the pressure reducing pump 46.

Here, it is desirable that the amount of pressure reduction of the ink suction pump 45 is greater than the amount of pressure reduction of the pressure reducing pump 46. As an example, the ink suction pump 45 is a tube pump and the pressure reducing pump 46 is a diaphragm pump, and thereby the amount of pressure reduction of the ink suction pump 45 may become greater than the amount of pressure reduction of the pressure reducing pump 46.

In addition, it is desirable that the ink suction pump 45 has a pressure reduction speed higher than the pressure reducing pump 46.

An atmosphere open path 56, through which the inside of the waste liquid container 47 is opened to the atmosphere, is provided to the waste liquid container 47. The atmosphere open path 56 is in a state in which the waste liquid container 47 constantly communicates with the air.

Filter Unit

The maintenance unit 40 according to the first embodiment further includes the filter unit 10 for adsorbing the volatile organic compounds contained in the ink discharged from the liquid ejection head 22.

The filter unit 10 has a first filter 11 disposed on the ink inflow side of the pressure reducing pump 46, a second filter 12 disposed on the ink discharge side of the pressure reducing pump 46, and a third filter 13 disposed on the atmosphere open side of the waste liquid container 47. The respective filters 11, 12, and 13 are filtering media which filter not only liquids but also gases. In the first embodiment, an activated carbon filter is used; however, there is no limitation on the material of the filter.

The first filter 11 is disposed on the second suction-side flow path 36 and collects the volatile organic compounds in the ink flowing out from the buffer tank 42 due to a suction force of the pressure reducing pump 46.

The second filter 12 is disposed on the second discharge-side flow path 37 and collects the volatile organic compounds which are not collected in the first filter 11 and remains in the ink discharged from the pressure reducing pump 46.

The third filter 13 is disposed on the atmosphere open path 56 connected to the waste liquid container 47 and collects the volatile organic compounds existing in the waste liquid container 47. Here, the volatile organic compounds contained in the ink discharged from the ink suction pump 45 or the volatile organic compounds vaporized from the ink stored in the waste liquid container 47 are included. The third filter 13 performs final collection such that collection efficiency of the volatile organic compounds which are discharged to the outside from the maintenance unit 40 is improved, and thus an elimination performance of the volatile organic compounds is improved.

After gas passes through the third filter 13, the gas has a small amount of the remaining volatile organic compounds. Therefore, the first filter 11 and the second filter 12 lower a collection load, and thus the filters function as the filter for a long period of time.

Liquid Ejection Head

Next, a configuration of the liquid ejection head 22 will be described in detail with reference to FIG. 2 and FIG. 3.

Figure 2:
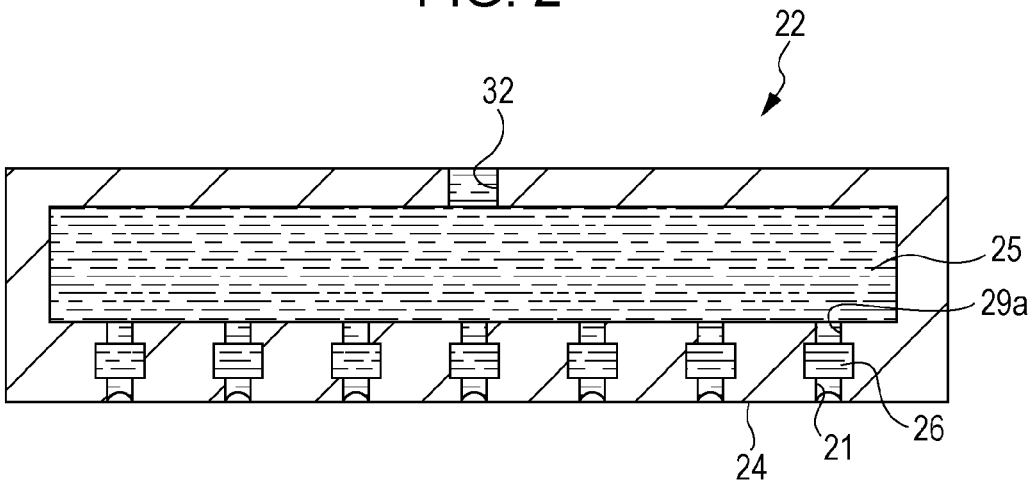
FIG. 2 is a diagram schematically illustrating a configuration of a liquid ejection head.

FIG. 2 is a diagram schematically illustrating a configuration of the liquid ejection head. FIG. 3 is a diagram schematically illustrating a configuration related to liquid ejection of the liquid ejection head. Further, FIG. 3 is a view schematically illustrating a sectional plane of the liquid ejection head 22, which intersects with a nozzle array direction (in right-left direction in FIG. 2) of the liquid ejection head 22 illustrated in FIG. 2.

Figure 3:
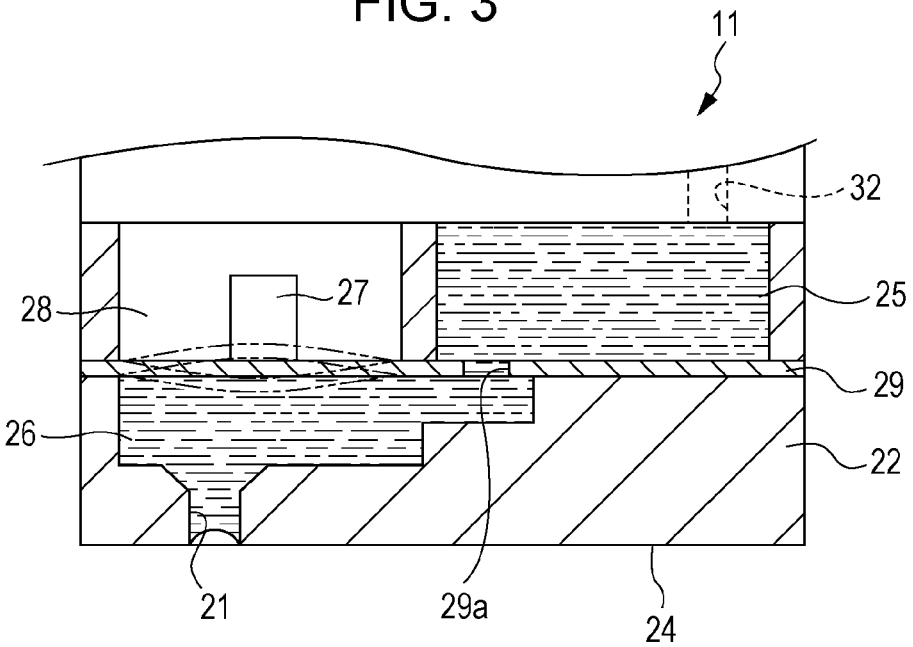
FIG. 3 is a diagram schematically illustrating a configuration related to liquid ejection of the liquid ejection head.

As illustrated in FIG. 2 and FIG. 3, the liquid ejection head 22 includes a common liquid chamber 25 that stores ink supplied through the supply flow path 32, the liquid chamber 26 having a changeable volume, an actuator 27 driven when ink is ejected from the nozzle 21, and an accommodation chamber 28 that accommodates the actuator 27, as well as the plurality of nozzles 21. The common liquid chamber 25 is commonly provided for the plurality of nozzles 21, while a plurality of the liquid chambers 26, a plurality of the accommodation chambers 28, and a plurality of the actuators 27 are provided, with one of the plurality of the liquid chambers 26, one of the plurality of accommodation chambers 28 and one of the plurality of actuators 27 being provided respectively for each single nozzle 21.

As illustrated in FIG. 3, the common liquid chamber 25 along with the accommodation chamber 28, and the liquid chamber 26 are partitioned by an elastically deformable vibration plate 29. In addition, the common liquid chamber 25 and the liquid chamber 26 communicate with each other through a communication hole 29*a* formed in the vibration plate 29. Therefore, the ink supplied from the liquid supply source 31 through the supply flow path 32 is temporarily stored in the common liquid chamber 25, and then the ink is supplied to each nozzle 21 through the communication hole 29*a* and the liquid chamber 26 from common liquid chamber 25. For example, the actuator 27 is a piezoelectric element which is contracted in a case where a drive voltage is applied. Therefore, when the drive voltage applied to the actuator 27 is changed, the vibration plate 29 is deformed as illustrated by a two-dot chain line in FIG. 3, the volume of the liquid chamber 26 is changed, and thereby the ink in the liquid chamber 26 is ejected as a droplet from the nozzle 21.

Next, an electrical configuration of a control unit 60 which is provided in the liquid ejection apparatus 1 will be described with reference to FIG. 4.

Figure 4:
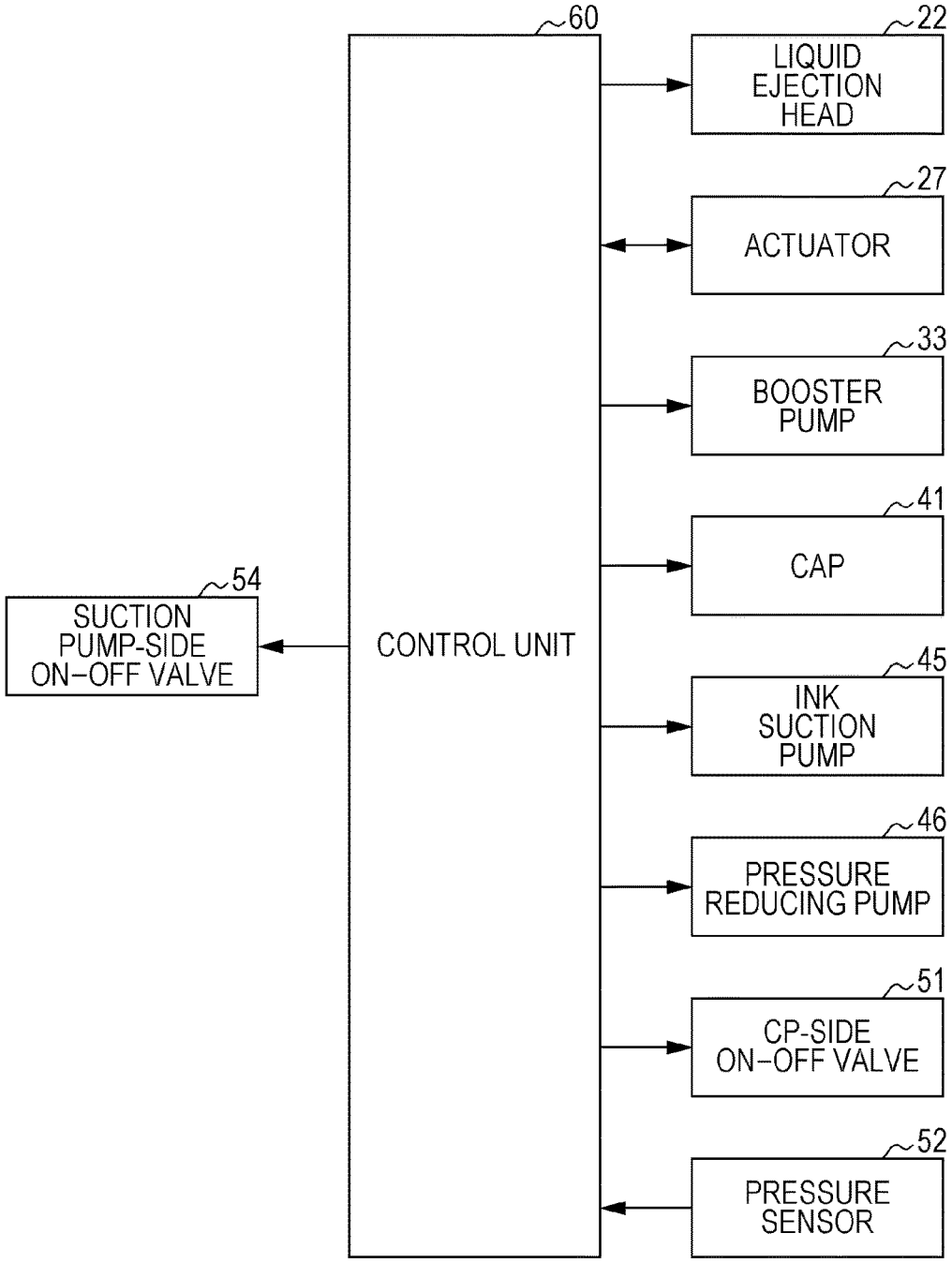
FIG. 4 is a block diagram illustrating an electrical configuration of the liquid ejection apparatus.

As illustrated in FIG. 4, the actuator 27 and a pressure sensor 52 are connected to an input-side interface of the control unit 60. In comparison, the liquid ejection head 22, the actuator 27, the pressurization pump 33, the cap 41, the ink suction pump 45, the pressure reducing pump 46, the CP-side on-off valve 51, and the suction pump-side on-off valve 54 are connected to an output-side interface of the control unit 60. Also, the control unit 60 causes the respective configurations connected to the output-side interface to operate in response to an output signal from the actuator 27 and the pressure sensor 52, and thereby the control unit performs maintenance of eliminating an ejection defect in the liquid ejection head 22.

Next, an outline of the maintenance of the liquid ejection apparatus 1 and a relationship between a discharge amount and a supply amount of a liquid in the same maintenance will be described with reference to FIG. 1 and FIG. 5.

Figure 5:
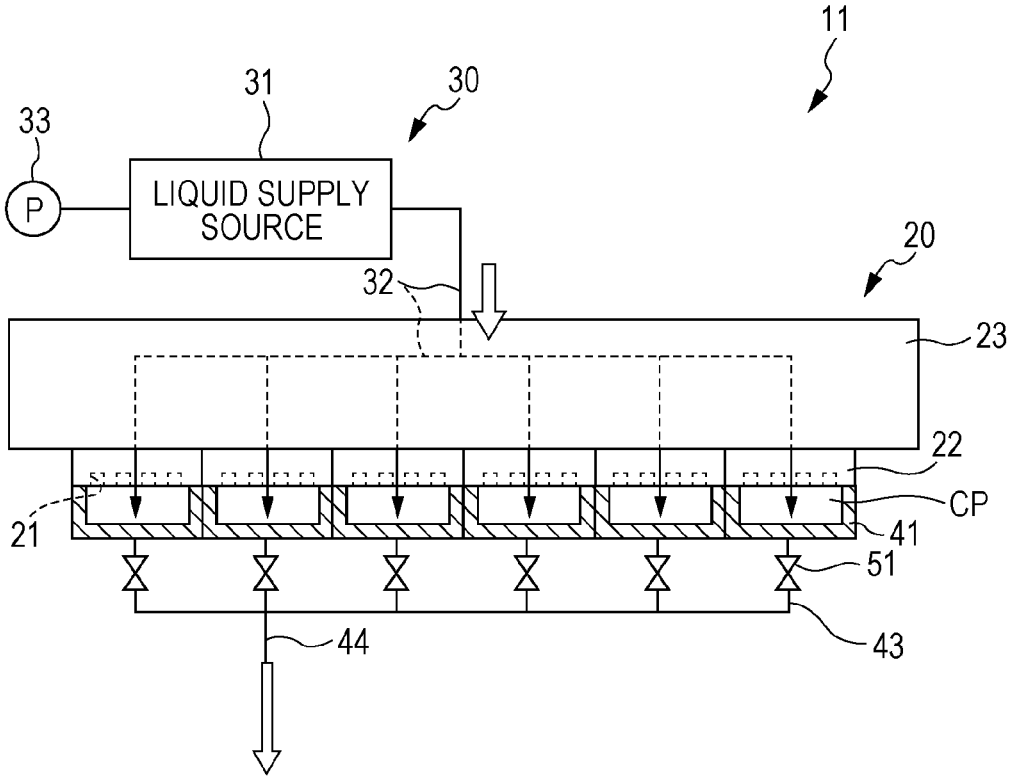
FIG. 5 is a diagram schematically illustrating a partial configuration of the liquid ejection apparatus during maintenance.

FIG. 5 is a diagram schematically illustrating a partial configuration of the liquid ejection apparatus during the maintenance.

In the first embodiment, in a case where there is a defective nozzle to which a foreign object such as a bubble is mixed in the nozzle 21 of the liquid ejection head 22, or the like, in order to eliminate ejection defect of such a defective nozzle, the maintenance of discharging a foreign object such as a bubble along with discharging the ink from the nozzle 21 of the liquid ejection head 22 is performed. To be more specific, as illustrated in FIG. 5, the liquid ejection head 22 as a target of the maintenance is capped such that the closed space CP is formed, and the closed space CP is subjected to pressure reduction such that the foreign object such as a bubble is discharged along with the ink from the nozzle 21 of the liquid ejection head 22.

First, as illustrated in FIG. 1, the pressure reducing pump 46 of the maintenance unit 40 is driven in a state in which the liquid ejection head 22 is capped and the inside of the buffer tank 42 is subjected to the rapid pressure reduction. In a state in which the buffer tank 42 is subjected to pressure reduction to have pressure lower than atmospheric pressure, any one of the CP-side on-off valves 51 is opened, and thereby any closed space CP communicating with the buffer tank 42 is subjected to the rapid pressure reduction. In this manner, the inside of the buffer tank 42 is subjected to pressure reduction such that negative pressure is accumulated therein, and thereby negative pressure is rapidly applied to the inside of the cap 41 such that ink containing bubbles, a foreign object, or the like is discharged from the nozzle 21 of the liquid ejection head 22. The ink discharged into the cap 41 flows into the buffer tank 42 having a reduced pressure through the branched flow path 43 and the joining flow path 44. Therefore, the volatile organic compounds exist in the buffer tank 42.

Subsequently, the driving of the pressure reducing pump 46 is continuously performed such that gas containing volatile organic compounds in the buffer tank 42 is suctioned. When the gas flowing out from the buffer tank 42 due to the suction force of the pressure reducing pump 46 passes through the first filter 11 provided in the second suction-side flow path 36, the volatile organic compounds contained in the gas are collected in the first filter 11. The volatile organic compounds remaining in the gas discharged from the pressure reducing pump 46 are collected in the second filter 12 provided in the second discharge-side flow path 37. Emission of gas containing volatile organic compounds from the buffer tank 42 is actively performed by the pressure reducing pump 46, and thereby the volatile organic compounds are collected in the first filter 11 and the second filter 12.

Gas, from which the volatile organic compounds are removed, flows to the waste liquid container 47 through the second discharge-side flow path 37.

Next, the suction pump-side on-off valve 54 is opened such that the ink suction pump 45 is driven and waste ink removed from the inside of the buffer tank 42 is discharged to the waste liquid container 47. The driving of the ink suction pump 45 is stopped, and then the reverse flow of the ink in the first suction-side flow path 34 is prevented by opening the suction pump-side on-off valve 54.

The inside of the waste liquid container 47 is opened to the atmosphere through the atmosphere open path. At this time, in the third filter 13 provided in the atmosphere open path 56, final collection of the volatile organic compounds contained in the gas in the waste liquid container 47, which is released to the atmosphere, is performed.

Since the ink which discharges the volatile organic compounds is stored in the waste liquid container 47, the third filter 13 is provided in the atmosphere open path 56 and the gas containing the volatile organic compounds is filtered through the third filter 13 and is exhausted.

According to the liquid ejection apparatus 1 of the first embodiment, it is possible to significantly reduce the content of the volatile organic compounds in the gas exhausted from the maintenance unit 40. The plurality of filters 11, 12, and 13 are disposed on a flow route of the gas containing the volatile organic compounds, and thereby it is possible to efficiently collect the volatile organic compounds.

In fulfillment of the maintenance (cleaning operation) of the liquid ejection head 22, the inside of the buffer tank 42 is subjected to pressure reduction by the pressure reducing pump 46 such that the negative pressure is accumulated therein, and thereby the negative pressure is rapidly applied to the inside of the cap 41 such that the ink is discharged from the liquid ejection head 22. In this case, the emission of the gas containing the volatile organic compounds from the buffer tank 42, into which a large amount of ink flows, is likely to be actively performed. According to this configuration, the plurality of filters 11, 12, and 13 provided on the downstream side from the buffer tank 42 enable effective removal of the volatile organic compounds contained in the gas discharged from the buffer tank 42.

Hence, since it is possible to sufficiently reduce the volatile organic compounds contained in the exhaust gas even in a printer which has a high printing speed as of a line head and is likely to generate a large amount of volatile organic compounds, it is possible to satisfy a regulation of a discharge amount of the volatile organic compounds, which is regulated with a discharge amount within a predetermined period of time.

In addition, the filter unit 10 is provided in the maintenance unit 40, and thereby it is possible to collect the volatile organic compounds in a tightly closed space. The maintenance unit 40 according to the first embodiment is configured to have high airtightness. Since a fluid (ink and gas containing volatile organic compounds which are volatilized) is contained in the maintenance unit 40 in a state of a relatively high airtightness, the filter unit 10 is provided in the maintenance unit 40, and thereby it is possible to significantly reduce an amount of the volatile organic compounds discharged from the maintenance unit 40 to the outside.

In addition, since the ink is contained in the maintenance unit 40 completely in a liquid state, it is possible to suppress volatilization of the volatile organic compounds contained in the ink. Accordingly, it is possible to reduce the volatile organic compounds discharged to the outside of the maintenance unit 40 and the liquid ejection apparatus 1.

Further, in the first embodiment, both the discharge sides of the ink suction pump 45 and the pressure reducing pump 46 are connected to the waste liquid container 47. Therefore, it is possible to contain, completely in the liquid state, the ink containing the volatile organic compounds in the waste liquid container 47. Hence, it is possible to suppress volatilization of the volatile organic compounds contained in the ink.

Further, the filter unit 10 of the first embodiment is configured to include three filters 11, 12, and 13; however, the number or positions of the filters are not limited thereto.

For example, in the first embodiment, the filters 11 and 12 are disposed at both the suction side and the discharge side of the pressure reducing pump 46; however, the filters may be disposed on any one side. In addition, a configuration in which the filter 13 is provided only in the atmosphere open path 56, without providing the filters 11 and 12 on the pressure reducing pump 46 side, may for example be provided.

The filter 11 provided on the suction side of the pressure reducing pump 46 enables reliable collection of the volatile organic compounds from the buffer tank 42 in which a large amount of the ink flows, and thereby a large amount of the volatile organic compounds is likely to be accumulated. In addition, even in a case where the filter 12 is provided on the discharge side of the pressure reducing pump 46 without providing the filter 11 on the suction side of the pressure reducing pump 46, similar effects to the above mentioned ones are obtained and it is possible to also collect volatile organic compounds which can be generated from the pressure reducing pump 46 itself. The positions and the number of the filters can be appropriately determined depending on a circumstance such as the effects, a size of a filter, collection performance of a filter, space in the liquid ejection apparatus 1, or the like. In addition, in a case where the filter 13 is provided only in the atmosphere open path 56, it is possible to completely collect the volatile organic compounds contained in the ink discharged from the ink suction pump 45 at only one position, the volatile organic compounds discharged from the pressure reducing pump 46, or the volatile organic compounds vaporized from the ink stored in the waste liquid container 47 and it is possible to efficiently reduce the volatile organic compounds from the entire maintenance unit 40.

In addition, in the configuration of the first embodiment, since the downstream side of the pressure reducing pump 46 is connected to the waste liquid container 47 through the second discharge-side flow path 37, it is possible to store the ink in the waste liquid container 47 and to suppress leakage to the outside (in the apparatus) even in a case where the ink flows around the pressure reducing pump 46.

Modification Example 1 of Filter Unit and Peripheral Structure Thereof

Next, Modification Example 1 of the filter unit and a peripheral structure thereof will be described.

FIGS. 6A to 6F are views illustrating the filter unit and the peripheral structure thereof according to Modification Example 1.

Figure 6A:
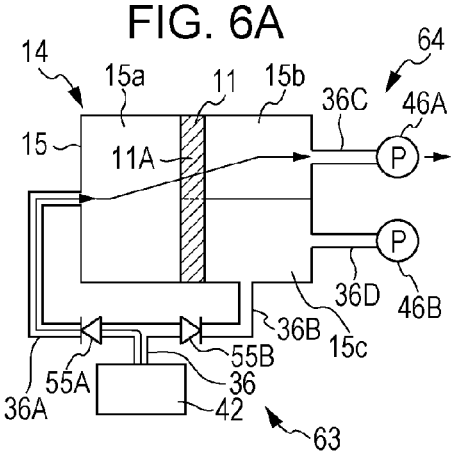
FIGS. 6A to 6F are views illustrating a filter unit and a peripheral structure thereof according to Modification Example 1.

As illustrated in FIG. 6A, according to modification example 1, a filter unit 14 is provided between the buffer tank 42 and a pair of pressure reducing pumps 46A and 46B.

A first selection mechanism 63 which selects an inlet-side flow path in the filter unit 14 is provided on the upstream side of the filter unit 14 and a second selection mechanism 64 which selects an outlet-side flow path in the filter unit 14 is provided on the downstream side of the filter unit 14.

The filter unit 14 is configured to include a filter accommodating section 15 which has an inflow chamber 15*a* and two filtration chambers 15*b* and 15*c*, and the filter 11 disposed in the filter accommodating section 15. The filter 11 is disposed between the inflow chamber and two filtration chambers such that the inflow chamber 15*a* is separated from two filtration chambers 15*b* and 15*c* and the respective filtration chambers 15*b* and 15*c* communicate with the inflow chamber 15*a* through the filter 11.

The second suction-side flow path 36 extending from the buffer tank 42 is branched into two flow paths at an intermediate position and is connected to the filter accommodating section 15 through a first branched flow path (inlet flow path) 36A and a second branched flow path (inlet flow path) 36B. The first branched flow path 36A is connected to the inflow chamber 15*a* of the filter accommodating section 15 and the second branched flow path 36B is connected to the filtration chamber 15*c* on one side. The first filtration chamber 15*b* of the filter accommodating section 15 is connected to the first pressure reducing pump 46A through a flow path (outlet flow path) 36C and the second filtration chamber 15*c* is connected to the second pressure reducing pump 46B through a flow path (outlet flow path) 36D.

The first selection mechanism 63 is configured to include the first branched flow path 36A, the second branched flow path 36B, a first on-off valve 55A provided in the first branched flow path 36A, and a second on-off valve 55B provided in the second branched flow path 36B.

The second selection mechanism 64 is configured to include the first pressure reducing pump 46A, the second pressure reducing pump 46B, a flow path 36C that connects the filter unit 14 with the first pressure reducing pump 46A, and the flow path 36D that connects the filter unit 14 with the second pressure reducing pump 46B.

In the Modification Example 1, a combination of the inlet flow path and the outlet flow path which are selected in the first selection mechanism 63 and the second selection mechanism 64 enables selection of whether the gas suctioned from the buffer tank 42 passes or does not pass through the filter 11. In other words, an opening/closing operation of the on-off valves 55A and 55B and a drive state of the pressure reducing pumps 46A and 46B are controlled, and thereby it is possible to select a flow route of the gas.

Modification Example 2 of Filter Unit and Peripheral Structure Thereof

Next, Modification Example 2 of the filter unit and a peripheral structure thereof will be described.

FIGS. 7A to 7E are views illustrating the filter unit and the peripheral structure thereof according to Modification Example 2.

Figure 7A:
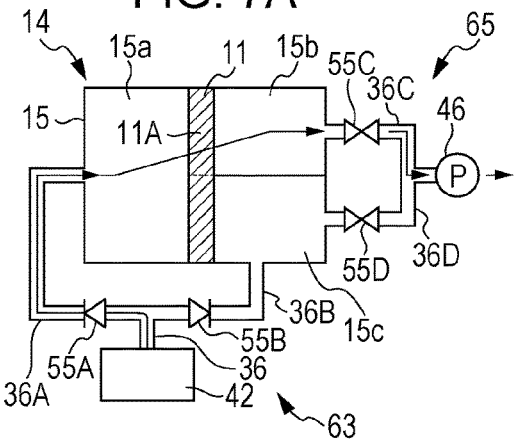
FIGS. 7A to 7F are views illustrating a filter unit and a peripheral structure thereof according to Modification Example 2.

As illustrated in FIG. 7A, according to Modification Example 2, a filter unit 14 is provided between the buffer tank 42 and one pressure reducing pump 46. Here, on-off valves 55C and 55D are also provided in the respective flow paths (outlet flow path) 36C and 36D which connect the filter unit 14 and the pressure reducing pump 46, the opening/closing control is performed, and thereby a suction operation can be performed using one pressure reducing pump 46.

Since the first selection mechanism 63 disposed on the upstream side of the filter unit 14 is the same as that in Modification Example 1, description thereof is omitted.

The second selection mechanism 65 disposed on the downstream side of the filter unit 14 is configured to include the flow paths 36C and 36D which connect the filter unit 14 and the pressure reducing pump 46, the on-off valves 55C and 55D provided in the flow paths 36C and 36D, and one pressure reducing pump 46.

Also, in the Modification Example 2, a combination of the inlet flow path and the outlet flow path which are selected in the first selection mechanism 63 and the second selection mechanism 65 enables selection of whether the gas suctioned from the buffer tank 42 passes or does not pass through the filter 11. In other words, an opening/closing operation of the on-off valves 55A, 55B, 55C, and 55D is controlled, and thereby it is possible to select a flow route of the gas.

The filter unit 14 according to respective Modification Examples 1 and 2 has a first flow path passing through the filter 11 and a second flow path without passing through the filter 11. The second flow path without passing through the filter 11 is a route of flowing directly to the second filtration chamber 15*c* of the filter accommodating section 15 from the buffer tank 42 and discharging, as it is, to the waste liquid container 47 due to the suction force of the pressure reducing pump 46. Since the gas flowing to the inflow chamber 15*a* of the filter accommodating section 15 from the buffer tank 42 needs to pass through the filter 11, the gas is discharged through the first flow path according to the invention. In a case of a route in which gas flowing to the second filtration chamber 15*c* reversely flows to the inflow chamber 15*a*, the gas needs to pass through the filter 11. Therefore, the route becomes the first flow path.

Next, the suction operation according to Modification Examples 1 and 2 will be described.

First Suction Operation

According to Modification Example 1, as illustrated in FIG. 6A, when the first on-off valve 55A provided in the first branched flow path 36A is opened such that the first pressure reducing pump 46A is driven, the gas flowing out from the buffer tank 42 flows to the inflow chamber 15*a* of the filter accommodating section 15 through the second suction-side flow path 36 and the first branched flow path 36A. The gas flowing to the inflow chamber 15*a* flows to the first filtration chamber 15*b* through the filter 11 due to the suction force of the first pressure reducing pump 46A. A filtering function of the filter 11 causes the gas having a reduced content of the volatile organic compounds to be discharged toward the waste liquid container 47 side from the pressure reducing pump 46A through the flow path 36C.

According to Modification Example 2, as shown in FIG. 7A, when the first on-off valve 55A provided in the first branched flow path 36A and the third on-off valve 55C provided in the flow path 36C are opened to drive the pressure reducing pump 46, the gas flowing out from the buffer tank 42 flows to the inflow chamber 15*a* of the filter accommodating section 15 through the second suction-side flow path 36 and the first branched flow path 36A. The gas flowing to the inflow chamber 15*a* flows to the first filtration chamber 15*b* through the filter 11 due to the suction force of the pressure reducing pump 46. The filtering function of the filter 11 causes the gas having a reduced content of the volatile organic compounds to be discharged toward the waste liquid container 47 side from the pressure reducing pump 46 through the flow path 36C.

In the suction operation, in any configuration, the gas passes the first flow path according to the invention and volatile organic compounds contained in the air is collected in a first region 11A of the filter 11.

Second Suction Operation

Figure 6D:
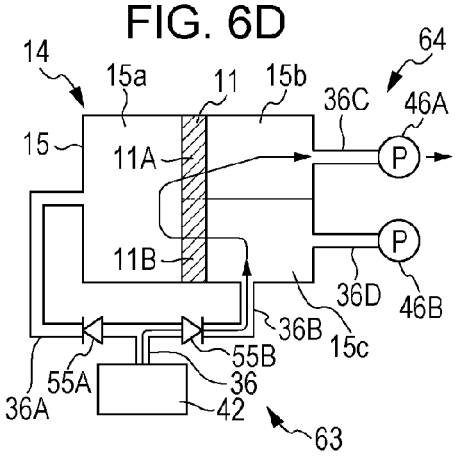
Figure 6B:
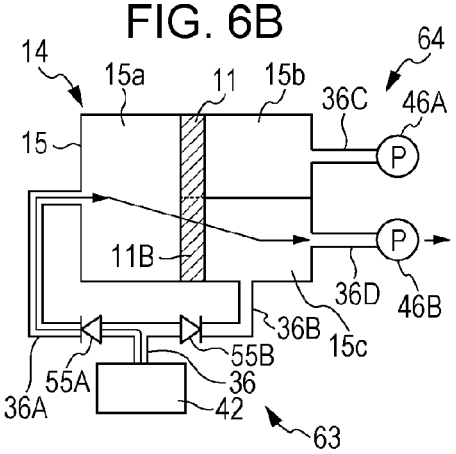

According to Modification Example 1, as illustrated in FIG. 6B, the first on-off valve 55A is opened to drive the second pressure reducing pump 46B. The gas flowing out from the buffer tank 42 flows to the inflow chamber 15*a* of the filter accommodating section 15 through the second suction-side flow path 36 and the first branched flow path 36A and flows out to the second filtration chamber 15*c* through a second region 11B of the filter 11 due to the suction force of the second pressure reducing pump 46B. The gas having a reduced content of the volatile organic compounds by the filter 11 is discharged toward the waste liquid container 47 side from the first pressure reducing pump 46A through the flow path 36D.

Figure 7D:
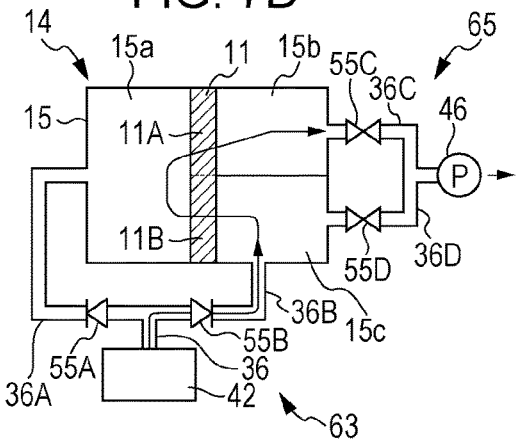
Figure 7B:
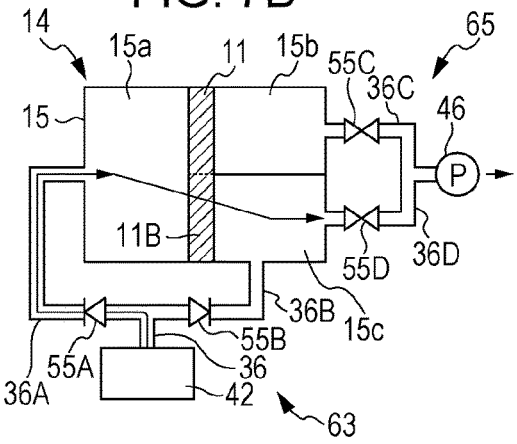

According to Modification Example 2, as illustrated in FIG. 7B, when the first on-off valve 55A and the fourth on-off valve 55D are opened to drive the pressure reducing pump 46, the gas from the buffer tank 42 passes through the second region 11B and flows to the second filtration chamber 15*c*.

In the suction operation, in all of the configurations, the gas passes through the first flow path according to the invention and the volatile organic compounds contained in the gas is removed in the second region 11B of the filter 11.

Third Suction Operation

Figure 6E:
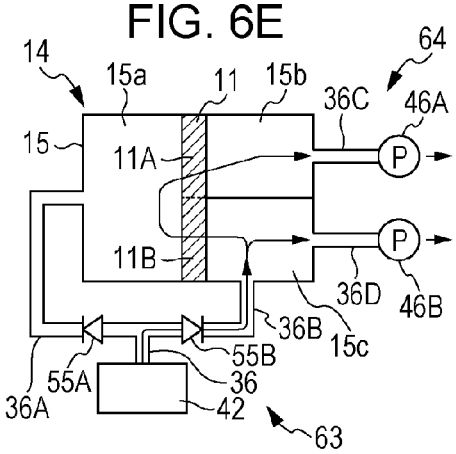
Figure 6C:
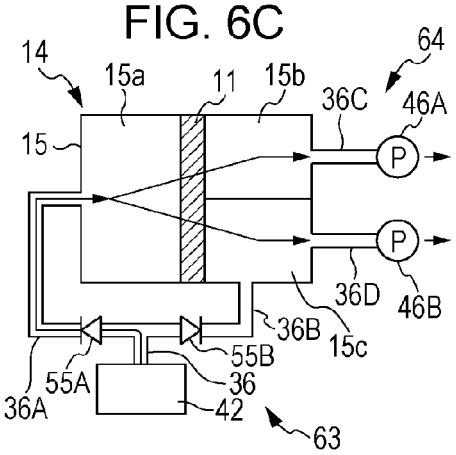

According to Modification Example 1, as illustrated in FIG. 6C, when the first on-off valve 55A is opened to drive both the first pressure reducing pump 46A and the second pressure reducing pump 46B, the gas from the buffer tank 42 passes through the entire regions (the first region 11A and the second region 11B) of the filter 11 and flows to the first filtration chamber 15*b* and the second filtration chamber 15*c*.

Figure 7E:
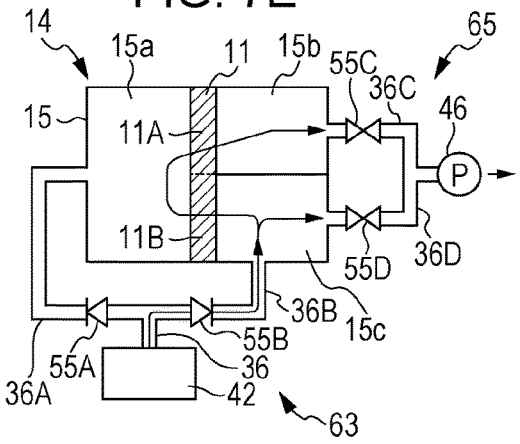
Figure 7C:
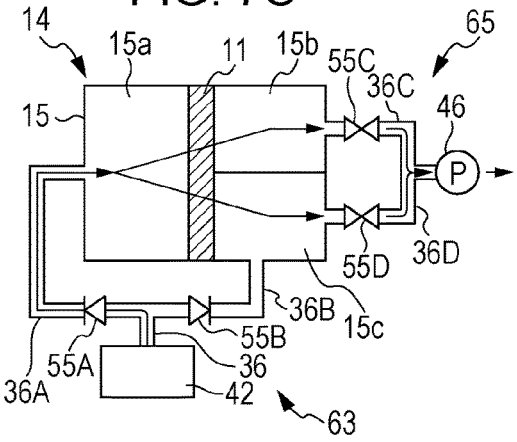

According to Modification Example 2, as illustrated in FIG. 7C, when the first on-off valve 55A on the upstream side and the two on-off valves 55C and 55D on the downstream side are opened to drive the pressure reducing pump 46, the gas from the buffer tank 42 passes through the entire region (the first region 11A and the second region 11B) of the filter 11 and flows to the first filtration chamber 15*b* and the second filtration chamber 15*c*.

In the suction operation, in all of the configurations, the gas passes through the first flow path according to the invention and it is possible to filter the volatile organic compounds contained in the gas using the entire region of the filter 11.

Fourth Suction Operation

According to Modification Example 1, as illustrated in FIG. 6D, the second on-off valve 55B is opened to drive the first pressure reducing pump 46A.

According to Modification Example 2, as illustrated in FIG. 7D, the second on-off valve 55B and the third on-off valve 55C are opened to drive the pressure reducing pump 46.

Then, in all of the configurations, first, the gas in the buffer tank 42 flows to the second filtration chamber 15*c* of the filter accommodating section 15 through the second suction-side flow path 36 and the second branched flow path 36B. The gas flowing to the second filtration chamber 15*c* passes through the second region 11B of the filter 11, flows to the inflow chamber 15*a*, then passes through the first region 11A of the filter 11, and flows to the first filtration chamber 15*b*, due to the suction force of the first pressure reducing pump 46A or the pressure reducing pump 46.

In the suction operation, the gas containing the volatile organic compounds passes through the filter 11 twice. The number of times the gas passes through the filter 11 is increased, and thereby it is possible to improve collection efficiency of the volatile organic compounds in the gas even using one filter 11. In this manner, also in the suction operation, the gas passes through the first flow path according to the invention.

Fifth Suction Operation

According to Modification Example 1, as illustrated in FIG. 6E, the second on-off valve 55B is opened to drive both the first pressure reducing pump 46A and the second pressure reducing pump 46B.

According to Modification Example 2, as illustrated in FIG. 7E, the second on-off valve 55B, the third on-off valve 55C, the fourth on-off valve 55D are opened to drive the pressure reducing pump 46.

Then, in all of the configurations, only a part of the gas passes through the filter 11 twice (first flow path) and the rest of the gas is discharged without passing through the filter 11 (second flow path).

In this manner, only a part of the gas may be filtered the second time and the rest of the gas may be discharged without being filtered. The remaining volatile organic compounds without being filtered in the filter unit 14 are removed in the filter provided in the atmosphere open path.

Sixth Suction Operation

Figure 6F:
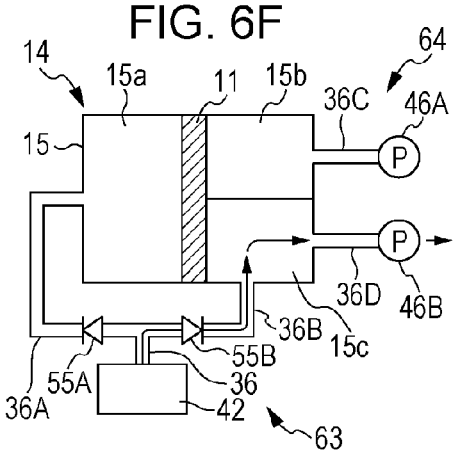

According to Modification Example 1, as illustrated in FIG. 6F, the second on-off valve 55B is opened to drive the second pressure reducing pump 46B.

Figure 7F:
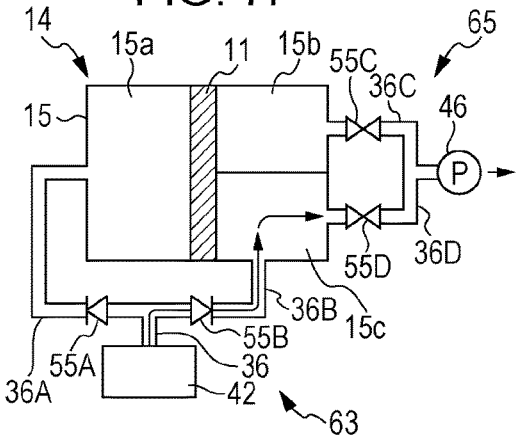

According to Modification Example 2, as illustrated in FIG. 7F, the fourth on-off valve 55D is opened to drive the pressure reducing pump 46.

In such an operation, it is possible to discharge the gas without passing through the filter 11 (second flow path).

As described above, according to the configurations of Modification Examples 1 and 2, in a configuration of the filter unit 14 and the periphery thereof, a flow path in which the filter 11 exists and a flow path in which the filter 11 does not exist are provided and driving of the pressure reducing pump or the like is controlled. In this manner, it is possible to select any one flow path through which the gas flows.

For example, only during a cleaning operation related to the volatile organic compounds, the gas in the buffer tank 42 passes through the filter 11. In a case except for the cleaning operation, the gas does not pass through the filter 11, or the like, and it is possible to appropriately select a flow path depending on an amount of the volatile organic compounds contained in the gas and a usage state of the filter 11.

The number of times the gas passes through the filter 11 is appropriately selected depending on concentration of the volatile organic compounds, and thereby high collection efficiency is achieved and it is possible to further reduce the amount of the volatile organic compounds discharged to the outside. In addition, in a case except for the cleaning operation, the gas does not pass through the filter 11, and thereby the service life of the filter 11 can be extended.

In addition, even if clogging or the like occurs in the filter 11, it is possible to suction the gas from the buffer tank 42 without losing a flow rate and to perform pressure reduction. The gas which has passed through the filter unit 14 is filtered in the filter 11 provided on the discharge side of the second pressure reducing pump 46B or the pressure reducing pump 46, and the volatile organic compounds are removed.

Second Embodiment

Next, a second embodiment of the invention will be described.

Figure 8:
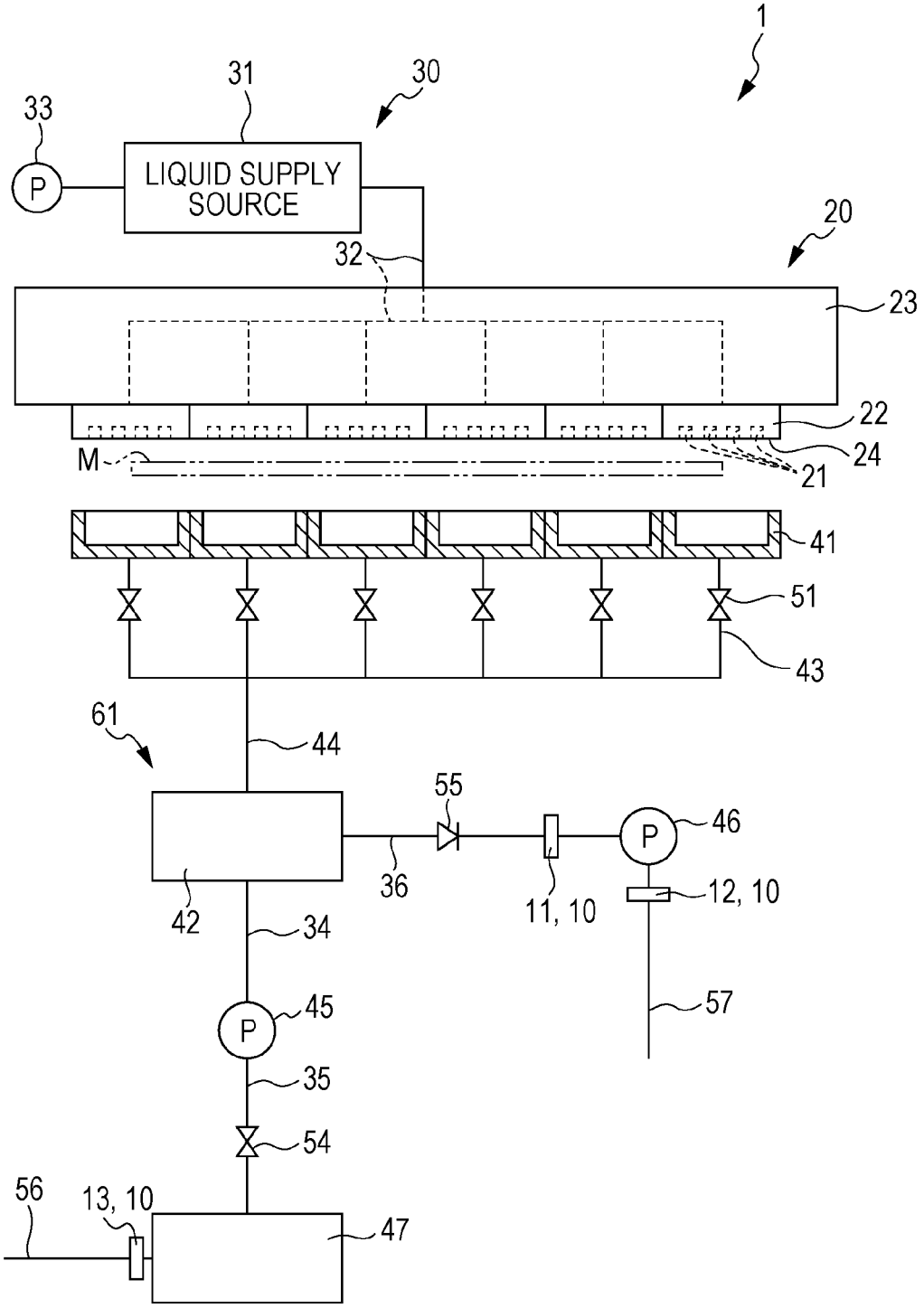
FIG. 8 is a diagram schematically illustrating an entire configuration of a liquid ejection apparatus of a second embodiment.

FIG. 8 is a diagram schematically illustrating the entire configuration of the liquid ejection apparatus of the second embodiment.

A basic configuration of the liquid ejection apparatus of the second embodiment to be described below is substantially the same as that of the first embodiment; however, a configuration of the maintenance unit is different. Hence, in the following description, the configuration of the maintenance unit will be described in detail and description of the common parts is omitted. In addition, in the respective drawings referred to in the description, the same reference sign is assigned to the same component which is common in FIG. 1 to FIG. 5.

The liquid ejection apparatus according to the second embodiment includes a maintenance unit 61 which mainly has the buffer tank 42, the pressure reducing pump 46, the ink suction pump 45, the waste liquid container 47, and the filter unit 10. The configuration is different from that of the first embodiment in that the downstream side of the pressure reducing pump 46 is not connected to the waste liquid container 47. In the second embodiment, an atmosphere open path 57 is connected to the downstream side of the pressure reducing pump 46 and constant atmospheric release is performed.

The second filter 12 of the filter unit 10 is disposed in the atmosphere open path 57. Since the volatile organic compounds, which is not removed in the first filter 11 and remains, is collected in the second filter 12, an amount of the volatile organic compounds contained in the gas which is released to the atmosphere is small.

Third Embodiment

Next, a third embodiment of the invention will be described.

Figure 9:
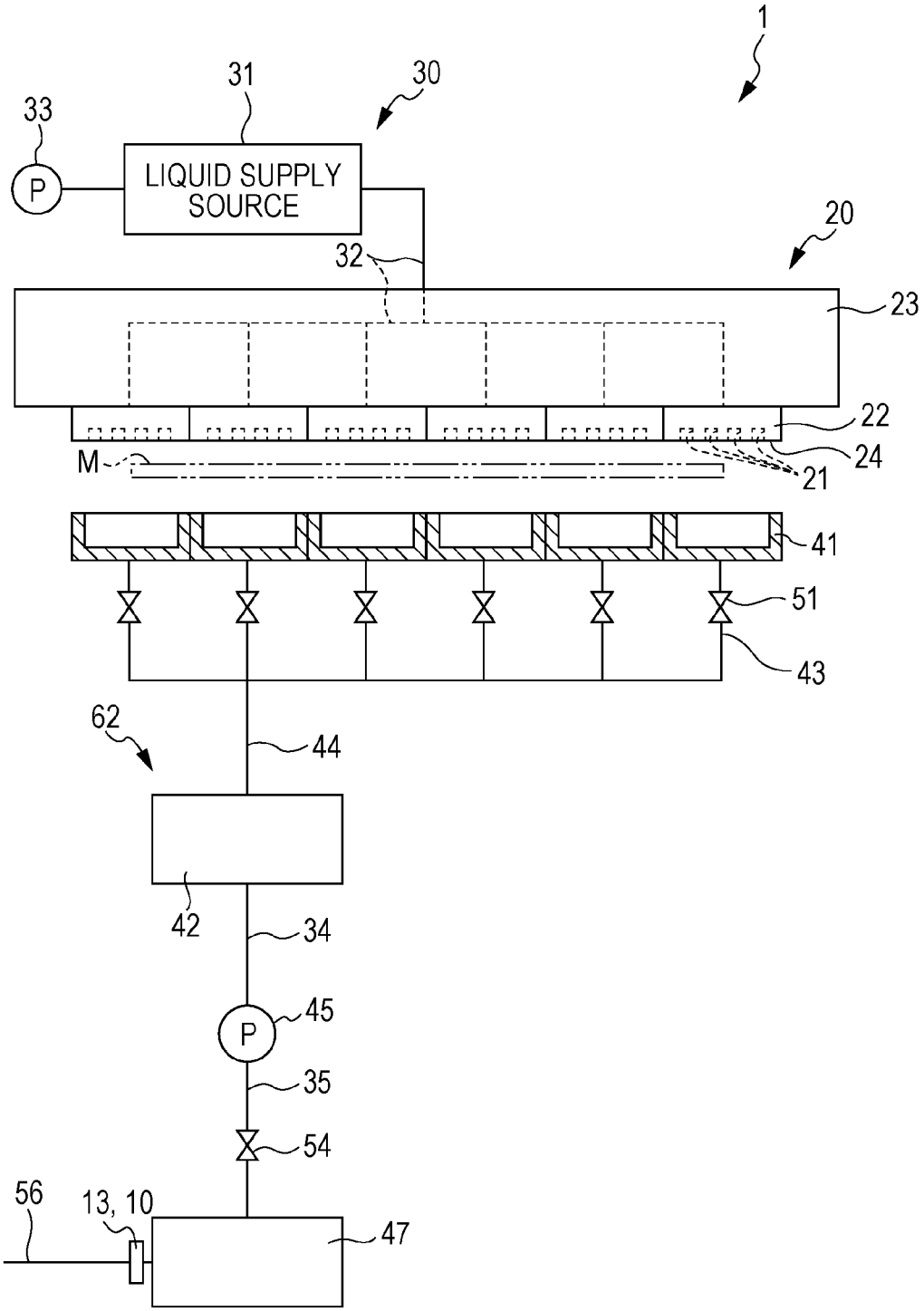
FIG. 9 is a diagram schematically illustrating an entire configuration of a liquid ejection apparatus of a third embodiment.

FIG. 9 is a diagram schematically illustrating an entire configuration of a liquid ejection apparatus of the third embodiment.

A basic configuration of the liquid ejection apparatus of the third embodiment to be described below is substantially the same as that of the first embodiment; however, a configuration of the maintenance unit is different. Hence, in the following description, the configuration of the maintenance unit will be described in detail and description of the common parts is omitted. In addition, in the respective drawings referred to in the description, the same reference sign is assigned to the same component which is common in FIG. 1 to FIG. 5.

The liquid ejection apparatus according to the third embodiment includes a maintenance unit 62 which mainly has the buffer tank 42, the ink suction pump 45, the waste liquid container 47, and the filter unit 10. The configuration is different from that of the above embodiments in that the maintenance unit 62 does not include the pressure reducing pump 46.

In the third embodiment, since the pressure reducing pump 46 is not provided, the ink suction pump 45 performs the pressure reduction in the buffer tank 42 during the maintenance.

The inside of the buffer tank 42 is subjected to the pressure reduction due to the suction force of the ink suction pump 45. Any CP-side on-off valve 51 is opened, the inside of the cap 41 has negative pressure, and thereby ink is suctioned from the nozzle. The ink and a foreign object such as a bubble discharged to the inside of the cap 41 flow to the inside of the buffer tank 42 and are discharged to the waste liquid container 47 due to the suction force of the ink suction pump 45. An operation of the ink suction pump 45 is stopped, then the suction pump-side on-off valve 54 is opened, and reverse flow of the ink or the like from the waste liquid container 47, which is opened to the atmosphere, is prevented. At this time, the volatile organic compounds contained in the gas released from the waste liquid container 47 are collected in the third filter 13 provided in the atmosphere open path 56. In other words, the volatile organic compounds vaporized from the ink in the buffer tank 42 and the waste liquid container 47 are collected in the third filter 13, and thereby it is possible to reduce the volatile organic compounds which are released to the outside.

In a case of the third embodiment, since the filter unit 10 includes only the third filter 13, it is preferable that a filter having high collection performance of the volatile organic compounds is used as the third filter 13. In addition, a plurality of filters may be disposed on the atmosphere open path 56. Alternatively, or in addition, a filter may be disposed on a flow path from the cap 41 to the waste liquid container 47.

As described above, in the maintenance unit of the liquid ejection apparatus of the embodiments, one or a plurality of filters are provided in a tightly closed space, that is, on a discharge flow path from the cap 41, the gas containing the volatile organic compounds is caused to pass through a filter and then to be discharged to the outside, and thereby it is possible to simply and effectively collect the volatile organic compounds contained in the gas. Hence, it is possible to reduce the volatile organic compounds which are discharged to the outside (machine body).

In addition, a VOC adsorbing filter that adsorbs the volatile organic compounds is further provided in a fan installation portion provided in a main body of the liquid ejection apparatus 1 and may be able to collect the volatile organic compounds which it is not possible to collect in the maintenance unit. In a case where the VOC adsorbing filter is provided, it is preferable that the atmosphere open side of the waste liquid container 47 and the discharge side of the pressure reducing pump 46 are opened toward the fan installation portion (adsorption filter) side.

In addition, in a case where the VOC adsorbing filter is not provided in the fan installation portion, it is preferable that the atmosphere open side of the waste liquid container 47 and the discharge side of the pressure reducing pump 46 are opened in a separating direction from the fan installation portion. Since the specific gravity of the volatile organic compounds is greater than water in many cases, it is preferable that the atmosphere open side of the waste liquid container 47 and the discharge side of the pressure reducing pump 46 are positioned below the fan installation portion. Otherwise, it is preferable that the atmosphere open side of the waste liquid container 47 and the discharge side of the pressure reducing pump 46 are opened toward the lower side of a housing of the liquid ejection apparatus 1.

In this manner, since the volatile organic compounds discharged from the maintenance unit are accumulated in the housing, it is possible to suppress an amount to be discharged to the outside.

As above, preferable embodiments according to the invention are described with reference to the accompanying drawings; however, it is needless to say that the invention is not limited to an example. Those skilled in the art may conceivable of various examples of modifications or alterations within the scope of the invention and it is to be understood that the various examples belong to the technical scope of the invention. An appropriate combination of the configurations of the embodiments may be performed.

According to the second embodiment, a configuration in which the filters 11 and 12 are on both the suction side and the discharge side of the pressure reducing pump 46 is employed; however, the filters may be disposed on either one of those sides only.

In addition, a configuration in which the filter 13 of the atmosphere open path 56 is omitted may be provided.

In the liquid ejection apparatus, there is a concern that so-called mist will be generated with a part of the ink scattered around like fog at the time of discharging of the ink, and thereby a recording medium to which the ink is discharged or a surface of a transport stage which transports the recording medium will be stained.

Therefore, a configuration, in which a mechanism that collects such mist is provided in the liquid ejection apparatus, may be employed.

Figure 10:
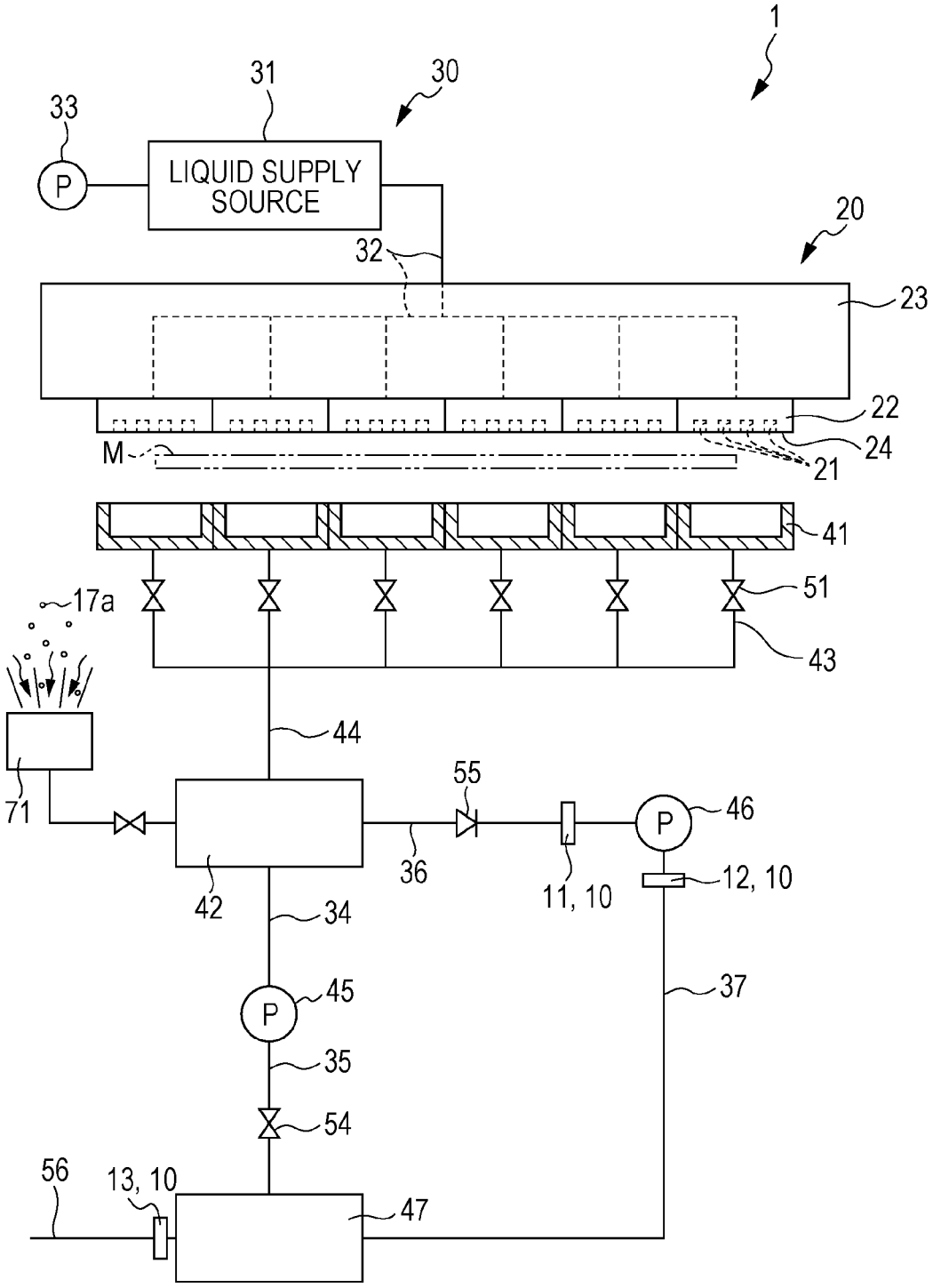
FIG. 10 is a diagram illustrating a configurational example in which a mist collecting unit is included.

FIG. 10 is a diagram illustrating a configurational example in which a mist collecting unit is included.

For example, as illustrated in FIG. 10, a configuration, in which a mist collecting unit (collecting unit) 71 that collects mist 17*a* existing in the apparatus is provided, may be employed. The downstream side of the mist collecting unit 71 is connected finally to the waste liquid container 47 and the collected mist 17*a* is contained in the waste liquid container 47 with waste ink. The volatile organic compounds contained in the mist 17*a* are collected in the respective filters 11, 12, and 13 of the filter unit 10.

In this manner, the mist 17*a* floating in the housing of the liquid ejection apparatus is collected, and thereby not only it is possible to prevent a stain on the recording medium and in the apparatus due to the mist 17*a*, but also it is possible to collect the volatile organic compounds contained in the mist 17*a* in the filter unit 10. Therefore, it is possible to reduce an amount of the volatile organic compounds which is discharged to the outside of the apparatus.

Further, the configuration, in which the mist collecting unit 71 is provided, can be used in any one of the respective embodiments described above.

In the above embodiments, the configuration, in which any buffer tank is included, is employed; however, a configuration, in which no buffer tank is included, may be employed.

Figure 11:
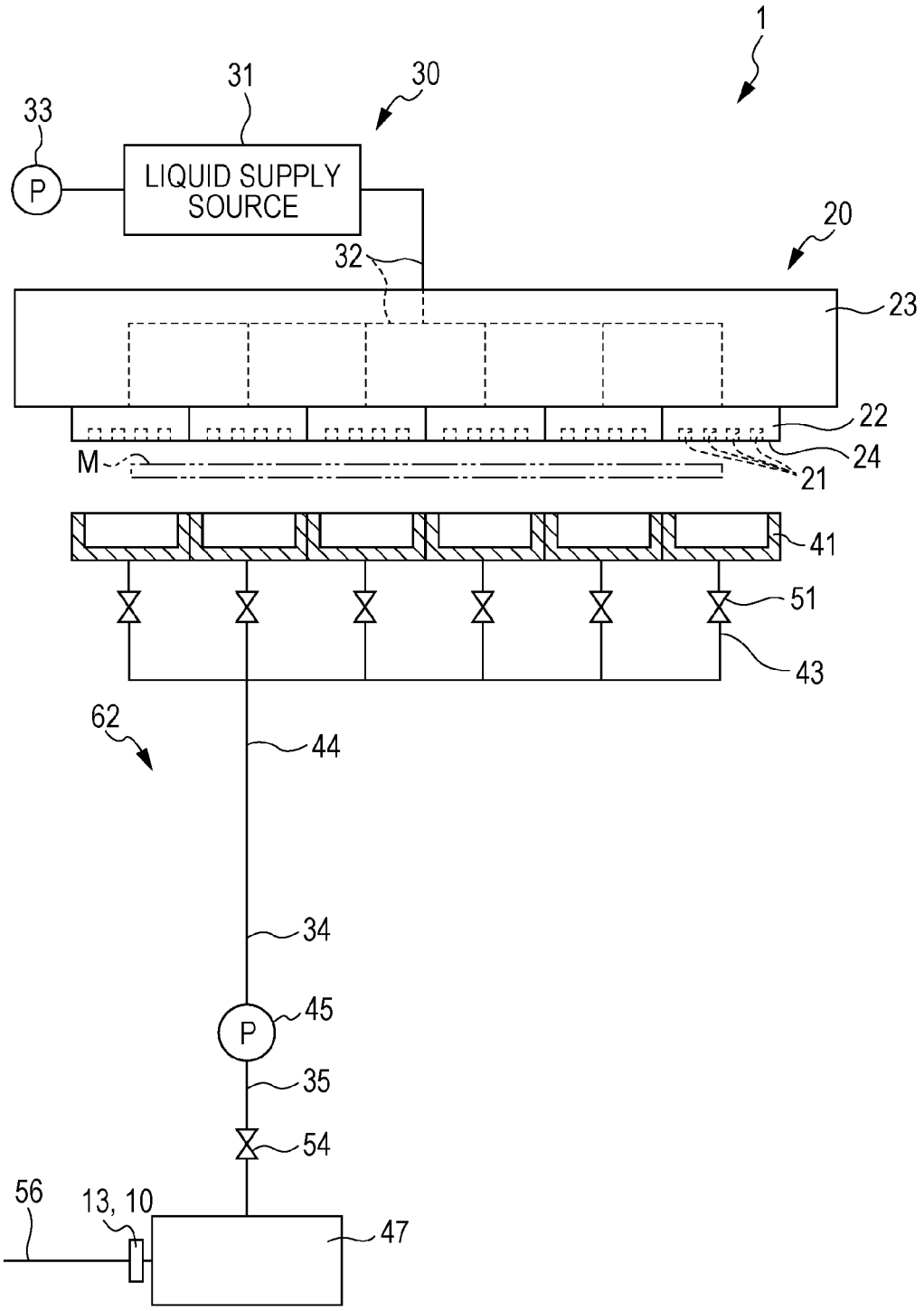
FIG. 11 is a diagram illustrating a configurational example in which no buffer tank is included.

FIG. 11 is a diagram illustrating a configurational example in which no buffer tank is included.

For example, as illustrated in FIG. 11, without the buffer tank, an end portion on the downstream side of the branched flow path 43 connected to each cap 41 may be connected to the first suction-side flow path 34. The closed space CP of any cap 41 may be directly subjected to the pressure reduction by the ink suction pump 45, and thereby ink containing bubbles or foreign objects from the nozzle 21 of the liquid ejection head 22 is discharged to the cap 41. The ink discharged in the cap 41 flows to the waste liquid container 47 through the branched flow path 43, the first suction-side flow path 34 and the first discharge-side flow path 35.

In addition, it is possible to appropriately change the number, position, or the like, of the filters. If at least one filter is disposed at any position of the maintenance unit, it is possible to reduce the volatile organic compounds which are discharged to the outside as compared with prior art. At this time, a filter is provided on the atmosphere open side of the maintenance unit, and thereby it is possible to efficiently perform collection in the filter, without the volatile organic compounds remaining in the maintenance unit.

The entire disclosure of Japanese Patent Application No. 2015-050509 filed Mar. 13, 2015 is expressly incorporated by reference herein.

What is claimed is:

1. A liquid ejection apparatus comprising:

a liquid ejection head having a nozzle which ejects a liquid containing volatile organic compounds to a medium; and a maintenance unit that has a cap, which forms a closed space including an opening of the nozzle, a suction unit that suctions a fluid from the closed space and discharges the liquid from the nozzle by reducing pressure of the closed space, a waste liquid container configured to contain the fluid suctioned from the closed space, and a buffer tank having a specific spatial volume and disposed downstream of the cap and upstream of the waste liquid container, the buffer tank communicating with the waste liquid container through the suction unit, wherein the maintenance unit is provided with a filter for adsorbing volatile organic compounds contained in the liquid discharged from the liquid ejection head, the filter being disposed downstream of the waste liquid container and having a downstream side open to the atmosphere.

2. The liquid ejection apparatus according to claim 1, wherein the maintenance unit includes:

a fluid discharge path that connects the cap with the suction unit, an on-off device that opens and closes the fluid discharge path, wherein the buffer tank forms a part of the fluid discharge path on the downstream side of the on-off device.

3. The liquid ejection apparatus according to claim 1, wherein the maintenance unit is provided with a first flow path, which passes through the filter, and a second flow path, which does not pass through the filter, wherein a first on-off valve, which is openable and closable of the first flow path, is provided on an inlet side of the first flow path, and wherein a second on-off valve, which is openable and closable of the second flow path, is provided on an inlet side of the second flow path, and combinations of opening and closing operations of the first on-off valve and the second on-off valve enable selection of a flow path through which the fluid passes.

4. The liquid ejection apparatus according to claim 1, further comprising;

a mist collecting unit that collects mist generated when the liquid is ejected from the liquid ejection head, wherein a discharge side of the mist collecting unit is connected with the waste liquid container.

5. A liquid ejection apparatus comprising:

a liquid ejection head having a nozzle which ejects a liquid containing volatile organic compounds to a medium; and a maintenance unit that has a cap, which forms a closed space including an opening of the nozzle, and a suction unit that suctions a fluid from the closed space and discharges the liquid from the nozzle by reducing pressure of the closed space, wherein the maintenance unit is provided with a filter for adsorbing volatile organic compounds contained in the liquid discharged from the liquid ejection head, and wherein the maintenance unit includes an on-off device that opens and closes the fluid discharge path, a buffer tank that has a predetermined spatial volume, and a pressure reducing unit that is connected to the buffer tank and reduces pressure of a space of the buffer tank, and wherein the filter is provided on at least one of a suction side and a discharge side of the pressure reducing unit.

6. The liquid ejection apparatus according to claim 5, wherein the maintenance unit has a waste liquid container which is able to contain the fluid suctioned from the closed space, and wherein the discharge side of the pressure reducing unit communicates with the waste liquid container through a passage.

7. The liquid ejection apparatus according to claim 6, wherein the filter is provided on the discharge side of the pressure reducing unit.

8. The liquid ejection apparatus according to claim 6, wherein the filter is provided on an atmosphere open side of the waste liquid container.

9. The liquid ejection apparatus according to claim 5, wherein the maintenance unit includes:

a fluid discharge path that connects the cap with the suction unit, an on-off device that opens and closes the fluid discharge path, wherein the buffer tank forms a part of the fluid discharge path on the downstream side of the on-off device.

10. A liquid ejection apparatus comprising:

a liquid ejection head having a nozzle which ejects a liquid containing volatile organic compounds to a medium; and a maintenance unit that has a cap which receives liquid discharged from the liquid ejection head, a waste liquid container configured to contain the liquid which is received by the cap, a liquid flow path which leads the liquid from the cap to the waste liquid container, and a filter which absorbs volatile organic compounds contained in the liquid, wherein the waste liquid container is opened to the atmosphere through an atmosphere open path separately provided from the liquid flow path, wherein the filter is disposed in the atmosphere open path.

11. The liquid ejection apparatus according to claim 10, wherein the atmosphere open path is a flow route of gas.

12. The liquid ejection apparatus according to claim 11, wherein the liquid suctioned by the suction unit is discharged to the waste container only.

13. The liquid ejection apparatus according to claim 10, wherein the maintenance unit further includes a suction unit that suctions the liquid from a closed space formed by the cap and discharges the liquid from the nozzle by reducing a pressure of the closed space, wherein the waste liquid container is disposed downstream of the suction unit, and wherein the atmosphere open path is disposed downstream of the waste liquid container.

* * * * *